US007388944B2

(12) United States Patent
Hempel et al.

(10) Patent No.: US 7,388,944 B2
(45) Date of Patent: Jun. 17, 2008

(54) DEVICE FOR GENERATION OF X-RAY RADIATION WITH A COLD ELECTRON SOURCE

(75) Inventors: Eckhard Hempel, Fürth (DE); Detlef Mattern, Erlangen (DE); Stefan Popescu, Erlangen (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 11/529,102

(22) Filed: Sep. 28, 2006

(65) Prior Publication Data

US 2007/0086571 A1 Apr. 19, 2007

(30) Foreign Application Priority Data

Sep. 28, 2005 (DE) ..... 10 2005 046 387
Oct. 17, 2005 (DE) ..... 10 2005 049 601

(51) Int. Cl.
*H01J 35/00* (2006.01)

(52) U.S. Cl. ..... 378/122; 378/137

(58) Field of Classification Search ..... 378/119–138
See application file for complete search history.

(56) References Cited

U.S. PATENT DOCUMENTS

| | | | | |
|---|---|---|---|---|
| 4,821,305 | A | 4/1989 | Anderson | 378/136 |
| 5,105,456 | A * | 4/1992 | Rand et al. | 378/125 |
| 5,193,105 | A | 3/1993 | Rand et al. | 378/137 |
| 6,553,096 | B1 | 4/2003 | Zhou et al. | 378/122 |
| 6,674,837 | B1 | 1/2004 | Taskar et al. | 378/122 |
| 6,760,407 | B2 | 7/2004 | Price et al. | 378/122 |
| 2002/0085674 | A1 | 7/2002 | Price et al. | 378/122 |
| 2002/0094064 | A1 | 7/2002 | Zhou et al. | 378/122 |
| 2004/0146143 | A1 * | 7/2004 | Price et al. | 378/119 |

FOREIGN PATENT DOCUMENTS

DE 197 00 992 C2 10/1999

OTHER PUBLICATIONS

"Imaging Systems for Medical Diagnostics," Krestel (1990) pp. 227, 228.
"Large Current Density from Carbon Nanotube Field Emitters," Zhu et al., Applied Physics Letters, vol. 75, No. 6 (1999) pp. 873-875.
"Electron Field Emission from Carbon Nanotubes," Cheng et al., Cr. Physique 4 (2003) pp. 1021-1033.
"Field Emission Patterns from Single-Walled Carbon Nanotubes," Saito et al., Jpn. J. App. Phys., vol. 36, Part 2, No 10A (1997) pp. L1340-L1342.
"Field Emitter Array Cathodes for High Current Density, High Current Applications," Schwoebel et al. IEEE (2004).

* cited by examiner

*Primary Examiner*—Courtney Thomas
(74) *Attorney, Agent, or Firm*—Schiff Hardin LLP

(57) ABSTRACT

A device for generation of x-ray radiation has one or more cold electron sources as a cathode and at least one x-ray target as an anode that are arranged in an evacuable housing. Upon application of an electrical voltage between cathode and anode, electrons emitted from the electron source are accelerated in an electron beam onto the x-ray target. A device for reduction of the proportion of positive ions in the region of the electron source is arranged between the electron source and the x-ray target in the housing. The device exhibits a long lifespan with good focusing capability and fast modulation capability of the electron beam.

13 Claims, 4 Drawing Sheets

DEVICE FOR GENERATION OF X-RAY RADIATION WITH A COLD ELECTRON SOURCE

BACKGROUND OF THE INVENTION

1. Field of the Invention

The present invention concerns a device for generation of x-ray radiation, in particular for usage in a computed tomography apparatus, the device being of the type having an evacuable housing in which one or more cold electron sources are arranged as a cathode and at least one x-ray target is arranged as an anode, such that upon application of an electrical voltage between the cathode and the anode, electrons emitted by the electron source are accelerated in an electron beam onto the x-ray target.

2. Description of the Prior Art

Devices for generation of x-ray radiation are used, for example, in medical diagnostics in order to acquire radiographic images or, in the case of computed tomography (CT), images of the inside of the body of a patient. The requirements for x-ray tubes used in computed tomography have steadily grown with the manifold possibilities of computed tomography. Modern computed tomography systems thus require x-ray tubes that allow the x-ray current thereof to be modulated with high speed in order, for example, to be able to achieve an optimized dose modulation or operation at two different energies with an equilibrium photon flow (flux).

U.S. Pat. No. 5,105,456 discloses an x-ray tube for a computed tomography apparatus in which an electron source with thermionic emission is used. For the generation of x-ray radiation, the housing of this x-ray tube rotates with the x-ray target fastened therein, so that the electron beam emanating from the electron source (which is stationary) hits the x-ray target over time at different points. The rotating housing enables a better cooling of the x-ray target during the operation. U.S. Pat. No. 5,193,105 also uses an electron source operating by thermionic emission. In the x-ray tube of this patent, additional electrode systems (known as a RICE system (RICE: rotating field ion controlling electrode) and known as an ICE system (ICE: ion controlling electrode)) are arranged in the housing in order to reduce the proportion of positive ions in the region between the electron source and the x-ray target. The positive ions are captured in the electrode system This can ensue with a stationary alternating field or with an alternating electrical field. Positive ions are generated by impacts of the accelerated electrons with remaining gas molecules in the evacuated housing of the x-ray tube. These positive ions neutralize the repulsive forces between the electrons in the electron beam, such that a good focusing of the electron beam on the x-ray target is enabled in the focusing region. Since an optimally small focus can be achieved only with a sufficient divergence of the electron beam in the region in front of the focusing region, the positive ions in this region are unwanted since they would prevent the required expansion of the electron beam due to the repulsive forces of the electrons. Due to the aforementioned electrode arrangement, the proportion of the positive ions in this region can be reduced such that overall a sharper focus of the electron beam on the x-ray tube can be generated.

Due to the heating required for the emission of electrons, x-ray tubes based on thermionic emission exhibit a slow reaction time, a high energy consumption, and have a high space requirement. Such x-ray tubes are therefore less suited for the aforementioned modern CT applications.

In addition to thermionic emission sources, field emission electron sources (known as cold electron sources) are also known for the generation of x-ray radiation. For example, United States Patent Application Publication No. 2002/0094064 discloses an x-ray tube that can be used in a computed tomography apparatus. In this x-ray tube a substrate with a layer made from a field-emissive material (such as, for example, carbon nanotubes) is used as an electron source. The individual regions of this electron source can be selectively addressed by an applied electrode structure in order to be able to emit local electrons by means of the localized electrical field. The emission can ensue at a temperature of 300 K (cold emission) and be very rapidly activated and deactivated by the electrodes. X-ray tubes operating on the basis of a cold electron emission have the advantage of an exact control capability of the x-ray emission, such that the x-ray exposure can be reduced and the temporal resolution in the x-ray exposure can be increased. The field emission current in these x-ray tubes is controlled by the voltage applied to the electron source and not by the temperature, as in the thermionic emission. A pulsed x-ray emission with a variable pulse width and a high repetition rate therefore can be achieved by suitable control of the applied electrical field. The control voltage normally lies in a range between merely 50 and 100 V, such that a fast pulse sequence is simple to generate.

U.S. Pat. No. 6,760,407 also discloses such a device for generation of x-ray radiation for a computed tomography apparatus of the type described above. In this x-ray tube the x-ray source exhibits a curved surface that produces a focusing effect on the electron beam. An additional focusing device therefore can be foregone in this x-ray tube.

The lifespan of such cold electron sources in x-ray tubes, however, has conventionally represented a significant problem. The shortened lifespan is particularly caused by the ion bombardment of the sensitive surfaces of the cold electron sources as explained, for example, in Y. Cheng et al., "Electron field emission from carbon nanotubes", C.R. Physique 4 (2003), pages 1021-1033 or in Y. Saito et al., "Cathode Ray Tube Lighting Elements with Carbon Nanotube Field Emitters", Japanese Journal of Applied Physics, Vol. 37 (1998), pages 346-348. The ion bombardment is caused by the positive ions that arise due to impacts of the residual gas molecules remaining in the housing with the electrons of the electron beam. To increase the lifespan of the electron source, the maintenance of a very high vacuum of approximately $10^{-8}$ Torr [mmHg] in the housing of the x-ray source is therefore proposed. This can be achieved, for example, by the introduction of getter material in the evacuated housing. Such a high vacuum in high-power (high-capacity) x-ray tubes, as are required in CT systems, is very difficult to maintain due to the high anode temperatures. Furthermore, due to the space charge effects the high vacuum prevents the generation of a sharply-focused electron beam on the anode, since the neutralizing positive ions are absent.

SUMMARY OF THE INVENTION

An object of the present invention is to provide a device for generation of x-ray radiation, in particular for usage in a computed tomography apparatus that enables a good focusing of the electron beam and exhibits a long lifespan.

The above object is achieved in accordance with the invention by a device for generation of x-ray radiation having an evacuable housing in which are arranged one or more cold electron sources as a cathode and at least one x-ray target as an anode, such that upon application of an electrical voltage between the cathode and the anode, electrons emitted from the electron source are accelerated in an electron beam onto the x-ray target, and wherein a device for reduction of the proportion of positive ions in the region of the electron source is arranged in the housing between the electron source and the x-ray target.

A cold electron source, in particular a field emission electron source, is thus used in the present device, in which cold electron source the electron current can be controlled via an electrical field applied to the electron source. A very fast reaction time for the electron emission (and thus also for the x-ray emission) is thereby achieved. Details with regard to the design and usage of such an electron source can, for example, be learned from the publication (cited above) by Y. Cheng et al. Due to the device arranged between the electron source and the x-ray tube to reduce the proportion of positive ions in the region of the else, bombardment of the surface of the electron source by such ions is prevented or at least significantly reduced. This increases the lifespan of the electron source considerably without hereby limiting the focusing capability of the electron beam on the x-ray target. Therefore an extremely high vacuum need not be maintained in the housing of the inventive device. Rather, a certain proportion of gas molecules for generation of positive ions by impacts with the electrons of the electron beam is desired, since these positive ions serve for neutralization of the repulsive forces of the electrons of the electron beam in the focusing region of the electron beam, i.e. in particular in the region in front of the x-ray target. Due to the reduction of the space charge effect (i.e. the mutual repulsion of the electrons) in this region, the electron beam retains its sharp focusing and enables a small focus on the x-ray target, even given a lower anode potential and high electron current.

The device for reduction of the proportion of positive ions has an electrode system that captures the positive ions in the corresponding region. This can be advantageously an ICE or a RICE electrode system in which a number of electrode pairs are arranged around the electron beam, to which electrode pairs a direct voltage or alternating voltage or a combination of the two is applied in a suitable manner.

Due to the fast modulation capability of the electron beam and also of the x-ray radiation as well as due to the high resolution that results due to the small focus of the electron beam on the x-ray target, the inventive device (also designated as an x-ray tube in the following) is suitable primarily for usage in a computed tomography apparatus. A variety of configurations of the computed tomography apparatus can thus be used, for example computed tomography systems of the third generation or computed tomography systems of the fifth generation, in which both the x-ray tube and the x-ray detector are arranged in a stationary manner.

The cold electron source (which can fashioned in the same manner as in the aforementioned publications of the prior art) is advantageously structured such that targeted individual regions can be activated for electron emission. This can be achieved by an electrode structure (in particular an electrode grid (lattice) or an electrode array) applied on the emitting material or arranged over the emitting material, in which electrode structure a voltage can be selectively applied to individual electrodes. The material emitting electrons preferably is a layer composed of carbon nanotubes; but it can also be formed by the known Spindt emitter.

In one embodiment of the electron source, a photoelectric layer composed of a semiconductor material is initially applied on the associated substrate and over this is applied the layer emitting electrons. A suitable electrode structure is in turn located on the electron-emitting layer. In this embodiment, the electrical voltage for the emission of the electrons can be locally applied to the electrode structure via radiation of a laser or an LED onto the photoelectric layer through the substrate that is transparent for the laser radiation. With this embodiment an x-ray tube can be achieved as is known in connection thermionic emitters, for example from U.S. Pat. No. 4,821,305, in which the electron source and the x-ray target are situated opposite one another in a cylindrical housing that rotates during operation.

DESCRIPTION OF THE PREFERRED EMBODIMENTS

Figure 1:
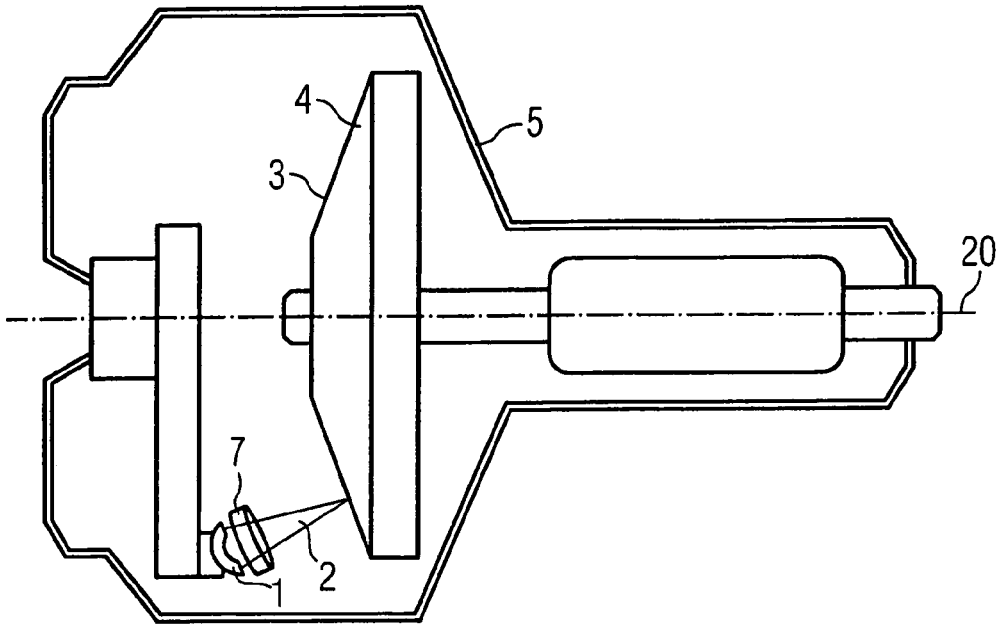
FIG. 1 shows a first exemplary embodiment of the present invention.

FIG. 1 schematically shows an example for an embodiment of the present device in which a rotating x-ray target 3 is used as an anode. The x-ray target 3 rotating around the rotation axis 20 and the cold electron source 1 are arranged in an evacuable housing 5. The cold electron source 1 exhibits a concave surface with which the emitted electron beam 2 is already focused onto the x-ray target 4. The electron emission ensues by the application of a suitable electrical field at the electron source 1, as is known in the prior art for such electron sources. A circular focal band 4 is generated on the x-ray target 3 via the rotation of the x-ray target 3 as an anode onto which the electrons of the electron beam 2 are accelerated, so the local temperature load is better distributed. Due to the striking electrons, the characteristic x-ray radiation is generated at the impact point. The characteristic x-ray radiation exits from the x-ray tube via a window (not shown) of the housing 5. The present example schematically shows the arrangement of an ICE and/or RICE electrode arrangement 7 in the region of the electron source 1. Positive ions that arise due to impacts of the electrons of the electron beam 2 with gas atoms remaining in the housing 5 are captured by this electrode arrangement 7 and do not arrive at the surface of the electron source 1. Such ions, however, remain in the focusing region of the electron beam such that the negative space charge effects impair the focusing are counteracted or cancelled.

Due to the normally relatively large area of the electron source 1 with the concave surface 1, a further focusing electrode (for example a Wehnelt electrode) can be omitted since the focusing already ensues by the directed emission from the electron source 1.

Figure 2:
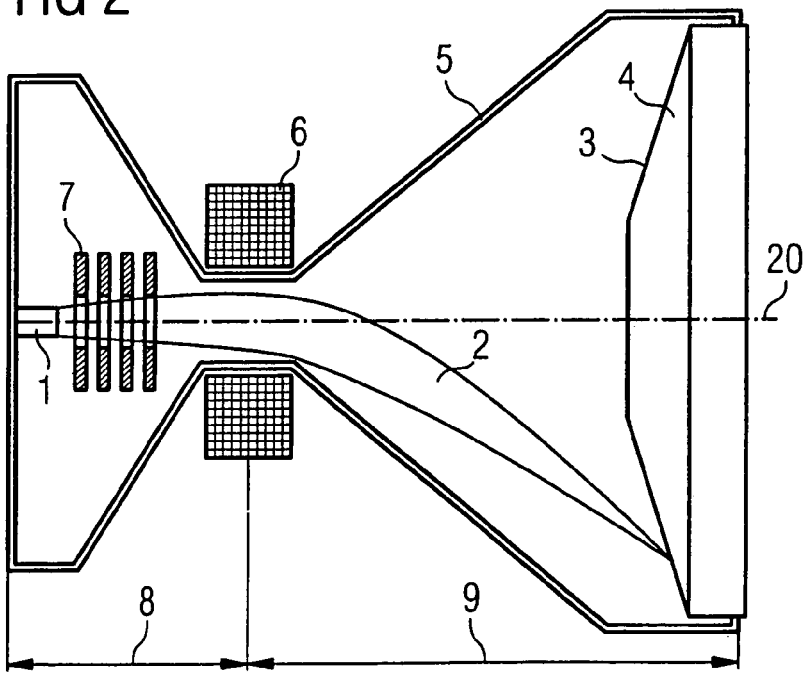
FIG. 2 shows a second exemplary embodiment of the present invention.

FIG. 2 shows in schematic representation a further example for an embodiment of the present device in which a rotating envelope tube is used. In this case, the electron beam 2 is directed by focusing and deflection coils 6 onto an annular track to distribute the thermal energy onto the x-ray target 3 on an annular band 4. Here as well an ICE and/or RICE electrode system 7 to capture the positive ions is arranged in the region of the cold electron source 1. This additionally prevents the influence of the positive ions on the electron beam 2 in this region 8 before the focusing region, such that the electron beam 2 can expand without hindrance up to the focusing and deflection coils 6. In the subsequent focusing region 9, however, these positive ions reduce or neutralize the repulsive forces of the electrons in the electron beam 2 such that the beam 2 can be optimally focused, even with low acceleration voltages and high currents.

Figure 3:
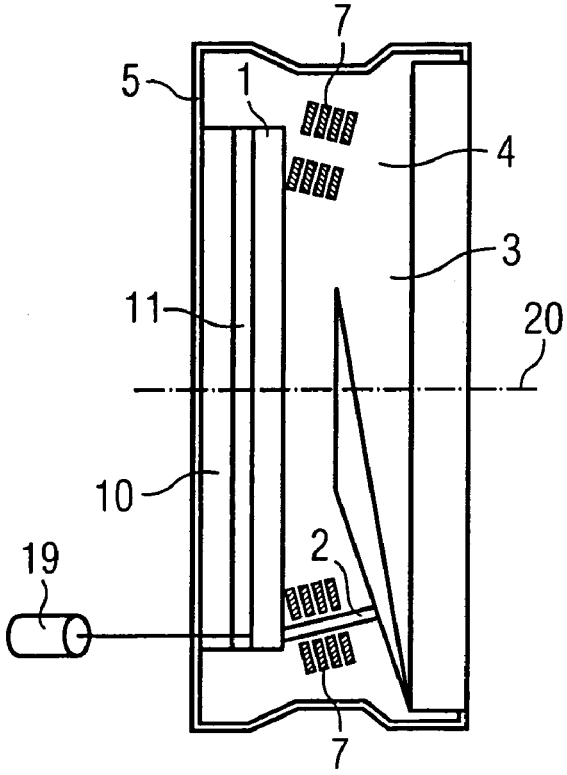
FIG. 3 shows a third exemplary embodiment of the present invention.
Figure 6:
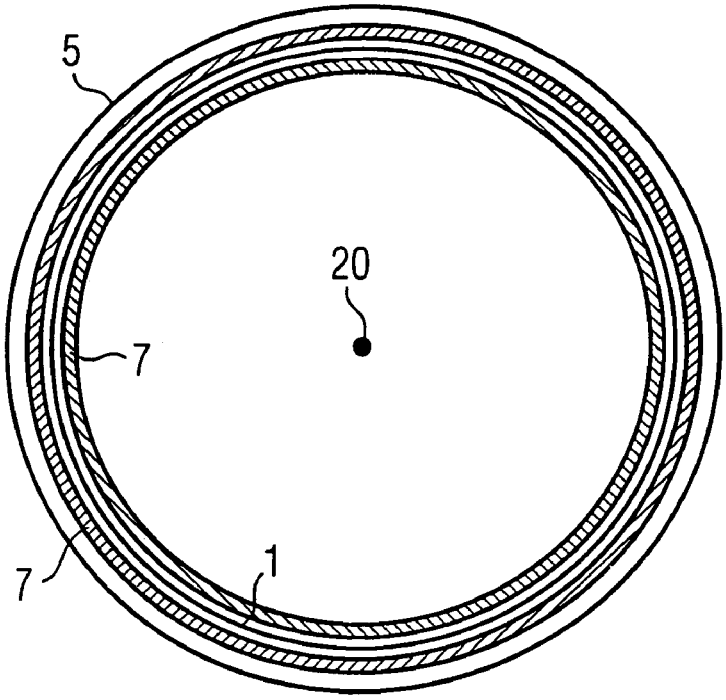
FIG. 6 shows the embodiment of FIG. 3 in an axial view.

FIG. 3 shows a further example of an embodiment of the present device in which the housing 5, with the electron source 1 arranged therein as well as the x-ray target 3 arranged therein, rotates around the axis 20. In this case a ring made of a photoelectric semiconductor material 11 is mounted on an electrode substrate 10 that is transparent for radiation from a laser 19. Situated on this ring in turn is a ring composed of electron-emitting material, with a micro-structured gate that forms the cold electron source 1. The gate electrode is structured like a net, such that the emission of the electrons in a structured (pixelated) form can ensue using the net-like array of micro-electrodes. Each of these micro-electrodes is separately connected via the photoelectric semiconductor material. This semiconductor material is locally activated via the external exposure with the laser 19 or a corresponding LED in order to generate free charge carriers (electron-hole pairs) that then produce the electrical connection between the micro-electrodes arranged there and the transparent electrode substrate 10 that lies at a gate control potential. By this design the local emission of electrons is activated only for the regions or pixels that are immediately located in the exposed region. By changing the ray cross-section and the shape of the incident light beam, it is therewith possible to influence the size and shape of the focus on the anode 3. Furthermore, a focus known as a spring focus can be generated by alternating beam deflection. A significant advantage of this arrangement is that the luminous power for the activation of the micro-electrodes is significantly less than the power in order to generate the x-ray current directly by the photoelectric effect. Due to the rotation of the box-shaped housing 5, the distribution of the thermal energy on the x-ray target 3 onto a corresponding annular band 4 is additionally achieved. An ICE and/or RICE electrode structure 7 for reduction of the proportion of positive ions, with which the lifespan of the device is increased, is also provided in this embodiment in the region of the electron source 1. FIG. 6 shows such an arrangement again in an axial view, wherein the ring of the cold electron source 1, the box-shaped housing 5 as well as an inner ring and an outer ring 7 of the ICE electrode structure can be recognized. In this example this electrode structure has a number of pairs of concentric electrode rings 7 arranged around the central axis 20, which pairs are situated one after another in the axial direction.

Figure 4:
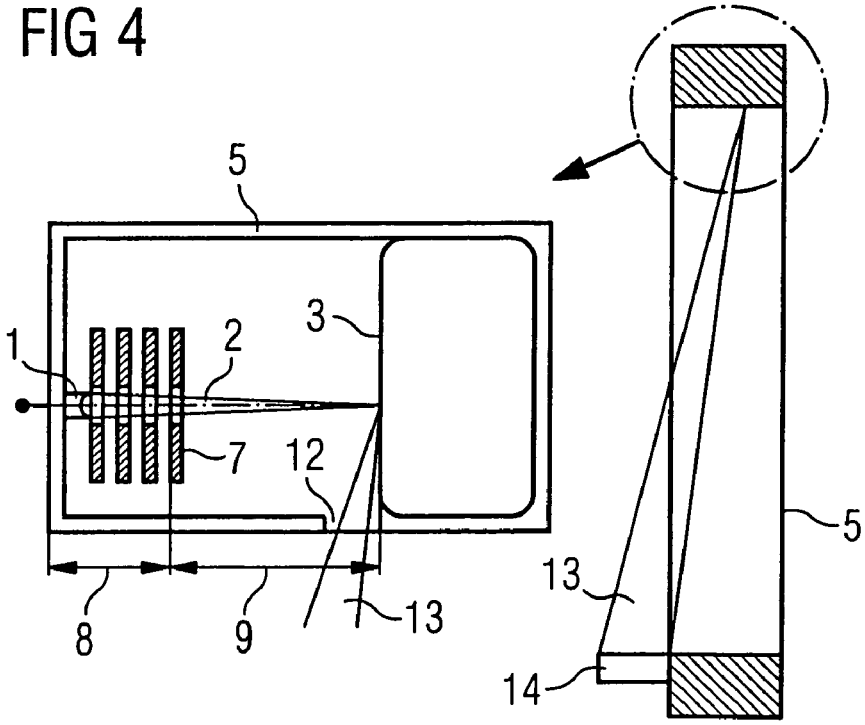
FIG. 4 shows a fourth exemplary embodiment of the present invention.

FIG. 4 shows a further example in which the housing 5 is fashioned as an annular housing that, for example, can be arranged around an examination space of a computed tomography scanner. The right portion of FIG. 4 hereby shows a schematized representation of this ring with the emitted x-ray 13 and a detector 14 arranged on the ring, on which detector 14 the x-ray 13 strikes. In the left portion of the Figure a section through the annular housing 5 is shown in enlarged representation, in which section the annular, revolving x-ray target 3 as well as the structured ring of the cold electron source 1 are to be recognized. The ICE or RICE electrode structure 7 is also arranged in the region of the electron source 1 in this example. Furthermore, the window 12 for the x-ray emission is to be recognized in this representation. Such a device enables the realization of a computed tomography apparatus of the fifth generation, in which both the x-ray tube and the x-ray detector are mounted in a stationary manner. The rotating x-ray is generated by an electron beam 2 rotating in the same manner by means of a corresponding local activation of the annular, rotating electron source 1.

Figure 5:
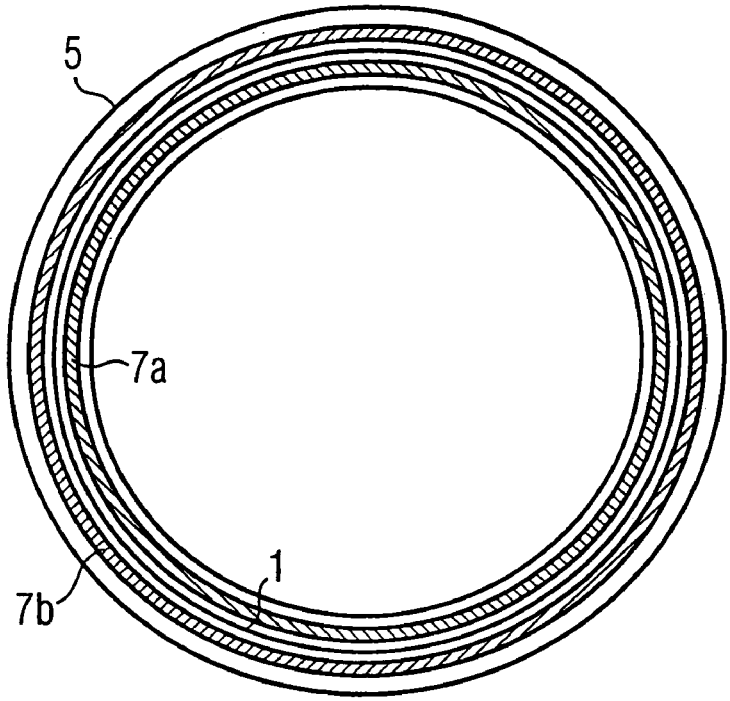
FIG. 5 shows the embodiment of FIG. 4 in an axial view.

FIG. 5 shows such an arrangement again in an axial view, wherein the ring of the cold electron source 1, the annular housing 5, an inner ring 7*a* of the ICE electrode structure as well as an outer ring 7*b* of the ICE electrode structure can be recognized. This electrode structure in this example thus has a number of pairs of concentric electrode rings 7*a*, 7*b* arranged around the central axis of the annular housing 5, which pairs are situated one after another in the axial direction.

Figure 7:
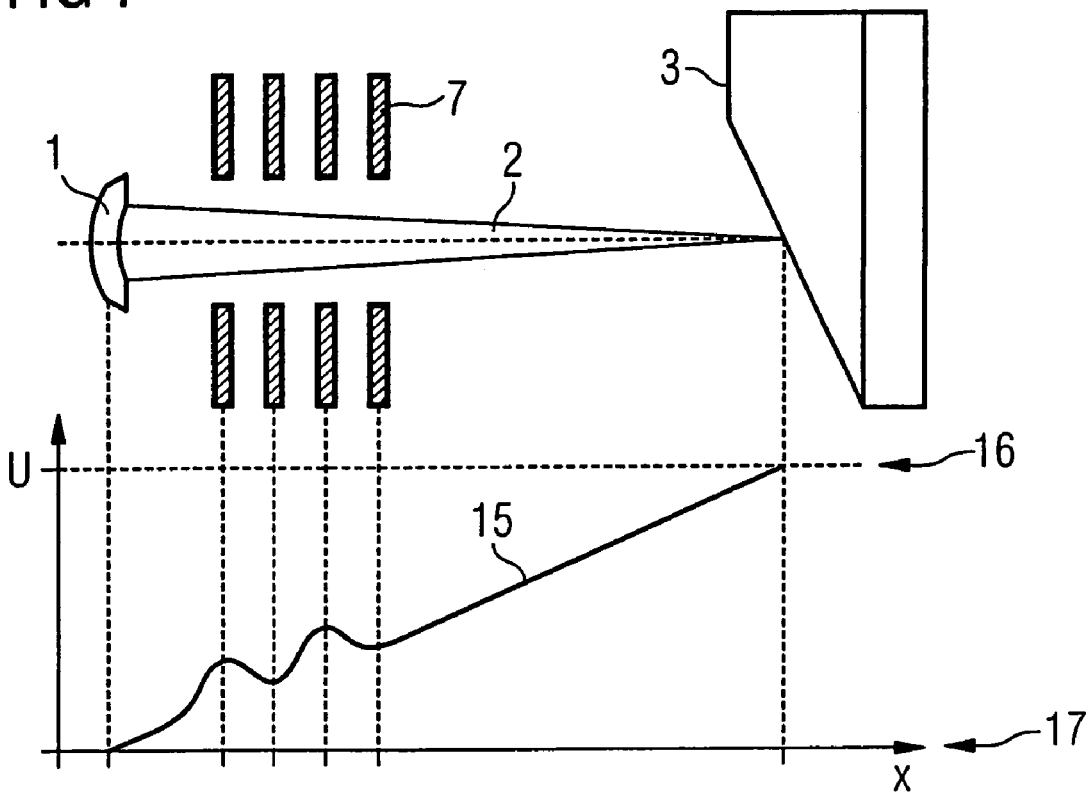
FIG. 7 shows an example for the arrangement of the electrodes for reduction of the proportion of positive ions in accordance with the invention.

FIG. 7 again shows the arrangement of the ICE or RICE electrode structure 7 in the region of the electron source 1. The voltage-path diagram situated under this shows the acceleration field profile 15 that results due to the different potentials of the anode (anode potential 16), of the cathode (cathode potential 17) and of the individual electrodes of the electrode structure 7. In order to avoid a disruption of the acceleration process, this electrode structure 7 is connected with a specific potential sequence that superimposes a rapid alternating electrical field on the linear anode acceleration field. The alternating components wipe away the heavy and slow-moving positive ions without significantly influencing the flow of the electrons. A passive resistor network that can be connected with the anode and cathode points in time can be used in order to dissipate the required potential for each electrode of the electrode structure 7. This is possible for every value of the tube high voltage.

Although modifications and changes may be suggested by those skilled in the art, it is the intention of the inventors to embody within the patent warranted hereon all changes and modifications as reasonably and properly come within the scope of their contribution to the art.

We claim as our invention:

1. A device for generating x-ray radiation, comprising:

an evacuable housing;

at least one cold electron source forming a cathode in said housing;

at least one x-ray target forming an anode in said housing;

an arrangement for applying an electrical voltage between said cathode and said anode to cause electrons to be emitted from said at least one electron source and accelerated in an electron beam onto said at least one x-ray target; and a device in said housing that reduces a proportion of positive ions that interact with said cold electron source, disposed between the electron source and the x-ray target.

2. A device as claimed in claim 1 wherein said device for reducing the proportion of positive ions is an electrode structure that captures said positive ions upon application of a voltage thereto, selected from the group consisting of direct voltage and alternating voltage.

3. A device as claimed in claim 1 wherein said at least one cold electron source is a field emission electron source.

4. A device as claimed in claim 1 wherein said at least one cold electron source comprises a substrate having a material structure that emits electrons upon application of an electrical field, and an electrode arrangement, selected from the group consisting of an electrode array and an electrode grid, disposed relative to said substrate to apply said electrical field.

5. A device as claimed in claim 4 wherein said material structure comprises a layer composed of carbon nanotubes.

6. A device as claimed in claim 4 wherein said material structure comprises a layer composed of Spindt emitters.

7. A device as claimed in claim 4 comprising a layer composed of photoelectric semiconductor material disposed between said material structure and said substrate, said substrate being transparent to radiation in an optical range.

8. A device as claimed in claim 7 wherein said housing is rotationally mounted and allows transmission of light in said optical range through said substrate onto said photoelectric layer.

9. A device as claimed in claim 1 wherein said x-ray target is mounted to rotate relative to said electron source so that, upon rotation of said x-ray target said electron beam successively strikes different points on said x-ray target along an annular path.

10. A device as claimed in claim 1 comprising a deflection device that interacts with said electron beam to deflect said electron beam between the device that reduces the proportion of positive ions and the x-ray target, said deflection device focusing said electron beam onto said x-ray target and directing said x-ray beam onto a circular path on said x-ray target.

11. A device as claimed in claim 9 wherein said device for reducing the proportion of positive ions is an electrode system that captures positive ions upon application of a voltage thereto, said electron system forming a tubular arrangement that surrounds said electron beam and comprises a plurality of pairs electrodes situated opposite each other.

12. A device as claimed in claim 1 wherein said housing forms a hollow ring around a central axis in which the electron source extends in a circle at one side thereof, and wherein said x-ray target extends in a circle at an opposite side of the housing, said housing having a circumferential window allowing x-ray radiation to exit from said housing, and said electron source being configured to generate a rotating x-ray focus on said x-ray target by selective activation of said x-ray source.

13. A device as claimed in claim 12 wherein said device that reduces said proportion of positive ions is an electrode structure that captures positive ions upon application of a voltage thereto, said electrode structure comprising a plurality of pairs of electrode rings disposed concentrically around said central axis, said pairs being situated in succession along said central axis.

* * * * *